US005125296A

United States Patent [19]

Nelson et al.

[11] Patent Number: 5,125,296

[45] Date of Patent: Jun. 30, 1992

[54] PNEUMATIC HOSE CLAMP ASSEMBLY TOOL

[75] Inventors: Danny M. Nelson, Mountain Home; Carl Ramey, Yellville, both of Ark.

[73] Assignee: Micro Plastics, Inc., Flippin, Ark.

[21] Appl. No.: 737,314

[22] Filed: Jul. 29, 1991

[51] Int. Cl.[5] ..... B25B 27/00

[52] U.S. Cl. ..... 81/9.3; 29/229

[58] Field of Search ..... 81/9.3, 424.5, 300, 81/301; 29/229, 243.56, 268, 280

[56] References Cited

U.S. PATENT DOCUMENTS

| | | | |
|---|---|---|---|
| 3,266,109 | 8/1966 | Thomas | 24/20 |
| 3,269,223 | 8/1966 | Pawloski | 81/1 |
| 3,605,200 | 9/1971 | Vallinotto et al. | 24/20 |
| 3,654,700 | 4/1972 | Pawloski | 30/347 |
| 3,661,187 | 5/1972 | Caveney | 140/123.6 |
| 3,765,087 | 10/1973 | Pawloski | 30/228 |
| 3,800,634 | 4/1974 | Clayton | 81/93 |
| 3,925,851 | 12/1975 | Bevans | 24/20 |
| 4,003,238 | 1/1977 | Oetiker | 81/9.3 |
| 4,091,483 | 5/1978 | Lewis | 7/132 |
| 4,162,640 | 7/1979 | Arnold | 81/9.3 |
| 4,368,569 | 1/1983 | Van Dam, Jr. | 29/229 |
| 4,747,432 | 5/1988 | Chrisley | 140/102.5 |
| 4,747,433 | 5/1988 | Dixon | 140/150 |
| 4,754,668 | 7/1988 | Oetiker | 81/9.3 |
| 4,919,017 | 4/1990 | Thomas | 81/9.3 |
| 4,935,992 | 6/1990 | Due | 24/16 R |

FOREIGN PATENT DOCUMENTS

| | | | |
|---|---|---|---|
| 2840107 | 3/1980 | Fed. Rep. of Germany | 81/9.3 |

*Primary Examiner*—Roscoe V. Parker
*Attorney, Agent, or Firm*—Stephen D. Carver

[57] ABSTRACT

An ergonomic, pneumatically-powered hand tool for installing hose clamps comprises an elongated barrel projecting from a pistol grip housing which pivotally mounts a locking jaw assembly for securely grasping clamps to be installed. A trigger-controlled valve assembly coupled to a source of high pressure air powers the tool. The jaw assembly comprises a pair of identical jaws pivotally coupled together to define a clamp-receptive mouth. Each jaw comprises a plurality of serially interconnected channels defined along the gripping end of each jaw, adapting the mouth to both accommodate clamps of varying sizes and to restrain clamps as they are compressed during installation. The gripping ends project outwardly beyond the barrel, and are spaced apart from the opposing terminal ends. An integral bearing plate is defined between the terminal end and the gripping end. The terminal ends of the jaws are resiliently biased together by a spring. Each terminal end comprises a sliding surface having a roller for deflecting an air-driven plunger between the jaws. When the tool is activated by compression of the trigger, pressurized air drives the plunger between the jaws, so that the terminal ends are pushed apart. Both jaws are forcibly pivoted, closing the mouth tightly about the clamp to install it. Rigid retainer walls associated with the gripping ends prevent deforming structural displacement during installation, so that a secure, leak-proof installation is achieved.

15 Claims, 3 Drawing Sheets

PNEUMATIC HOSE CLAMP ASSEMBLY TOOL

BACKGROUND OF THE INVENTION

The present invention relates broadly to power tools for installing plastic hose or bundle clamps. More specifically, the present invention relates to an ergonomic, pneumatically-powered hand tool for installing resilient tube clamps on hoses, wire bundles, or the like.

As will be appreciated by those experienced in the art, it is extremely important to achieve a leak-proof coupling between hose sections that are to be joined. In the early years of the art, hose clamps commonly comprised a length of wire or other resilient metal adapted to be twisted tightly about the tubes to be connected. Various tools were developed for twisting the ends of the wire tightly together. Representative of such art is Clayton, U.S. Pat. No. 3,800,634, issued Apr. 2, 1974; U.S. Pat. No. 4,368,569 issued Jan. 18, 1983 to Van Dam; and, Lewis, U.S. Pat. No. 4,091,483 issued May 30, 1978. An automated wire clamping tool is taught by Chrisley in U.S. Pat. No. 4,747,432 issued May 31, 1988.

However, in recent years, resilient, plastic hose clamps enjoy increased popularity, and the last-mentioned wire-twist tools are not well-suited for use therewith. The plastic clamps are more resilient, less prone to deterioration from exposure, capable of maintaining a tighter grip, and generally more economical than their metallic forerunners. Representative of the art in modern resilient clamps are the following U.S. patents: Due, U.S. Pat. No. 4,935,992; Vallinotto, U.S. Pat. No. 3,605,200; Wenk, U.S. Pat. No. 4,128,918; and Bevins, U.S. Pat. No. 3,925,851. Such clamps broadly comprise a resilient, circular band and an integral head having a pair of interlocking jaws. A plurality of teeth associated with the jaws lock together to achieve a secure coupling. In order to achieve proper locking, the jaws must be maintained in proper alignment and retained against lateral or torsional displacement during installation.

Unfortunately, proper alignment and locking are difficult to achieve by manual installation. Thomas U.S. Pat. No. 3,266,109 issued Aug. 16, 1966 illustrates the use of ordinary pliers for installing a locking clamp about a hose. However, based on our experimentation, manual force applied via such conventional plier tools is inadequate for achieving a satisfactory lock.

Hand-held pliers generally cannot deliver adequate locking power. Importantly, pliers do not provide means for firmly retaining the clamp against lateral or torsional displacement during installation.

Hence, various power tools have been proposed in the art. The pneumatic clamp-tightening tool of Dixon, U.S. Pat. No. 4,747,433, issued May 31, 1988 comprises a hand-held pneumatic gun actuating a slidable ram, which in turn rotates a pivotal head. The head grasps a free end of a flexible wire tie and pulls it tightly about the periphery of the hose. A serrated nose frictionally engages the locking head of the tie during tightening.

A similar concept is advanced in U.S. Pat. No. 3,661,187 issued May 9, 1972 to Caveney. Therein is disclosed a hand-held, pneumatically actuated strap puller. The puller pivots in response to actuation of an interiorly disposed ram. As it pivots, the head draws the free end of the strap fastener into the machine until the strap is tightly fastened about the wire bundle. Thereafter, the machine severs the remaining loose end of the strap and locks the bound end in place.

The aforedescribed clamp art provides no guidance for the proper, leak-proof installation of locking clamps. There are provided no means for properly grasping and retaining the locking head of a clamp in alignment prior to installation. Moreover, the pulling or twisting pressure applied by such tools is generally not adequate for pressing the cooperating jaw members of various types of clamps into locking engagement. Depending upon the size and bulk of the hose or bundle to be clamped, we have found it desirable to deliver clamping pressures between twenty and 150 psi.

One very relevant prior art tool is disclosed by Pawloski, in U.S. Pat. No. 3,269,223 issued Aug. 30, 1966. The tool comprises an elongated body terminating at one end in a clamping jaw and its opposite end in a valve assembly adapted to be coupled to an external fluid source. Activation of the tool is achieved by compressing a spring-biased button, which drives an interior plunger forward into the gripping head. The plunger forcibly contacts roller heads, which in turn rotate the gripping jaws into an open position. The cooperating jaws are biased to a closed position by a torsion spring. The Powloski tool fails to provide means for securely gripping a resilient locking clamp. There are no means for controlling torsional displacement of the clamp during installation and locking. Moreover the elongated body can be cumbersome and difficult to manipulate, because the body must be held in alignment with the clamp. In addition, the jaws of the tool provide no gripping surface for engaging clamps or locks of various types.

Hence, it is desired to provide a hand-held, power tool capable of maintaining the cooperative jaws of a locking clamp in alignment while delivering selectively variable amounts of locking pressure.

SUMMARY OF THE INVENTION

Our new, pneumatically-powered tool is used for installing resilient locking clamps or the like upon hoses, wire bundles, or other tubular or cylindrical objects. The ergonomically efficient tool comprises a rigid, pistol-grip housing that is conveniently grasped by an operator. The housing supports an outwardly projecting barrel pivotally mounting a clamping jaw assembly which first receives and then manipulates clamps to be installed. The tool is activated by a mechanical trigger assembly mounted on the handle, and it may be conveniently manipulated in one hand.

Preferably the jaw assembly comprises a pair of identical cooperating jaws. The rigid jaws are specially configured so that a pair may be coupled together, pivotally collaborating to form a clamp-receptive, captivating mouth. The jaws are configured symmetrically so that their opposite sides cooperate with the one another to reliably captivate clamps during the installation process, with no chance of clamps escaping, breaking or deforming.

Each jaw comprises a terminal end disposed generally within the tool barrel, a gripping end which projects outwardly from the barrel, and an integral, somewhat circular bearing plate disposed between the two ends. The bearing plates abut one another when the jaws are assembled, and they enable relative rotation of the jaws between an open position and a closed position. The bearing plates are confined about an axis defined by a rigid mounting trunnion, which penetrates both bearing plates and the tool barrel.

The gripping end of each jaw comprises a contoured gripping surface having a plurality of serially connected, arcuate channels. The channels are separated from one another by rigid teeth. The channels are adapted to accommodate clamps of various types and sizes. The teeth vigorously engage the friction surfaces of the clamps to be installed.

A rigid retainer wall forms the outer side of each jaw terminal end. The walls of cooperating jaws prevent undesired displacements of the clamp during installation, so that a secure, leak-proof lock is achieved.

The jaw assembly is activated in response to depression of the trigger assembly, which in turn activates a pneumatically-powered plunger assembly. The plunger assembly comprises a rigid plunger slidably displaceable within a hollow chamber defined within the tool housing, which forcibly deflects the jaws. A valve assembly establishes fluid-flow communication between the chamber and an external source of high pressure air. An interior passageway extends between the air inlet and the interior plunger chamber for venting.

Admission of air into the passageway is controlled by a poppit valve activated by the trigger. When the trigger is depressed, the poppit valve opens the passageway, admitting a burst of air into the interior plunger chamber. The pressurized air forcibly contacts the plunger, driving it forward into contact with the terminal ends of the jaws. The tip of the plunger is deflected by rollers into the jaw assembly, and forces the jaws to rotate about their axis to close the mouth.

Thus it is a broad object of the present invention to provide a power tool for installing locking hose clamps.

It is a further fundamental object of the present invention to provide a pneumatically-powered tool for rapidly installing plastic hose clamps upon a variety of objects, such as hoses, wire bundles or the like.

Another basic object of the present invention is to provide an ergonomic clamp installation tool.

Another basic object of the present invention is to provide a power operated clamp installation tool that captivate the clamp being installed so that it cannot escape.

An additional broad object of the present invention is to provide a power clamping tool that can be easily manipulated and which is capable of installing clamps of varying sizes.

Yet another object of the present invention is to provide a pneumatically-powered hose clamping tool that maintains the clamp's locking members in proper alignment during installation.

A similar object of the present invention is to provide a pneumatic power tool for rapidly installing plastic hose clamps.

Still another object of the present invention is to provide an ergonomic clamp installation tool that can be comfortably manipulated with one hand.

A further object of the present invention is to provide a clamp installation tool capable of delivering varying amounts of pressure suitable to install clamps of various sizes.

Yet another object of the present invention is to provide a pneumatically-powered clamp assembly tool that accommodates locking clamps of various dimensions.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
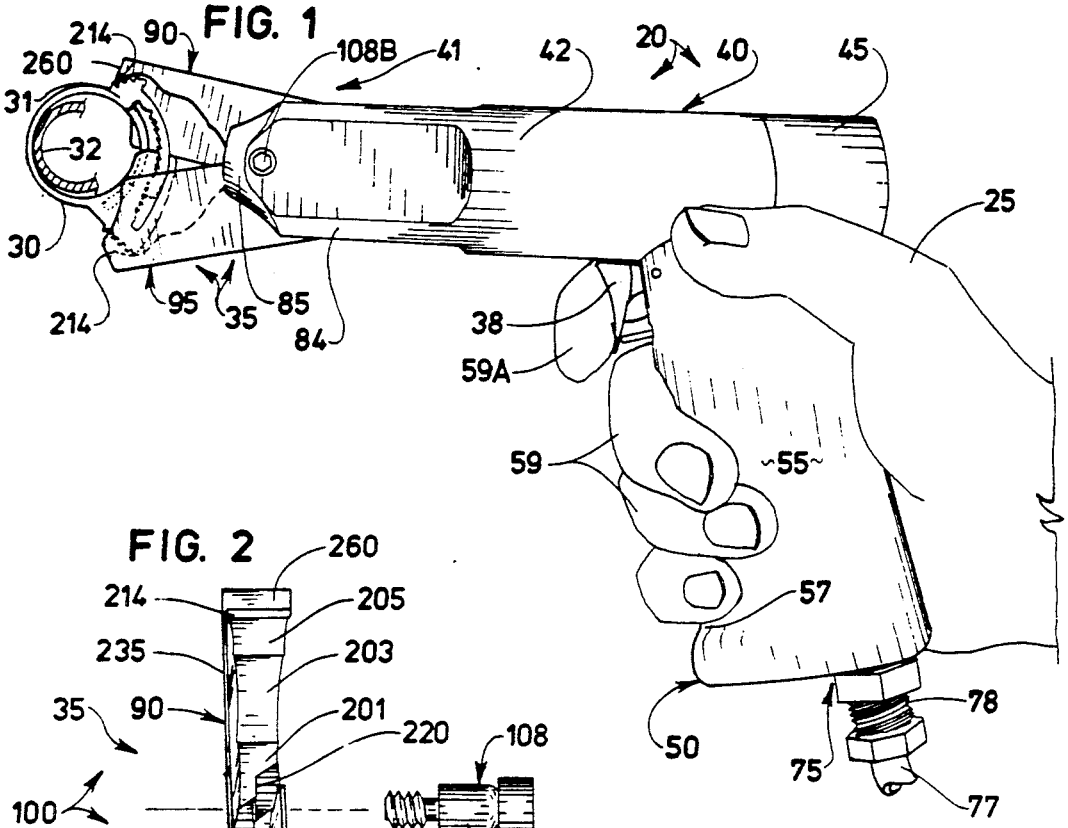
FIG. 1 is a fragmentary pictorial view of the best mode of our new Pneumatic Hole Clamp Assembly Tool.
Figure 2:
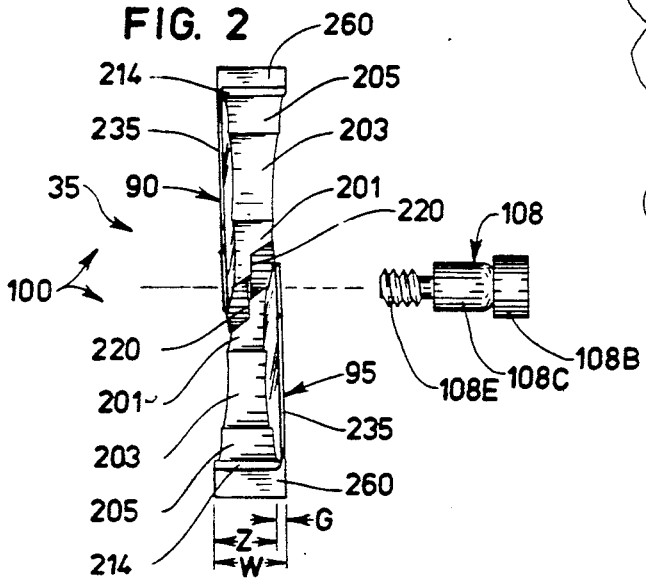
FIG. 2 is an enlarged, fragmentary, partially exploded front elevational view taken from a position generally to the left of FIG. 1 and illustrating the tool mouth disposed in an open, clamp-receptive position.
Figure 3:
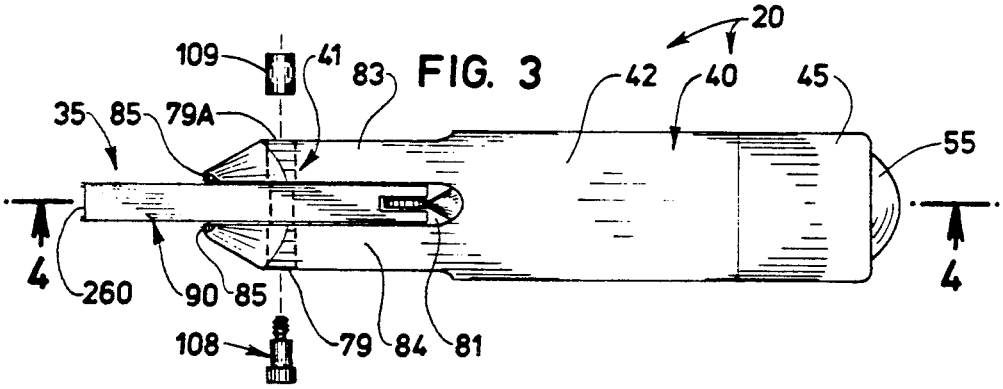
FIG. 3 is a partially exploded top plan view of our new tool.

With initial reference directed to FIGS. 1-3, the best mode of our new Pneumatic Hose Clamp Assembly Tool is broadly designated by the reference numeral 20. The pistols-shaped tool 20 is easily held in the user's hand 25 for installing a resilient clamp 30 onto a hose 32, wire bundle, or the like. Hose 32 may be any cylindrical or tubular item requiring clamping. The locking head 31 of clamp 30 is engaged by a pivotal jaw assembly broadly designated by the reference numeral 35 projecting from the front of the tool. Tool 20 locks the clamp when the user activates the trigger assembly 38. A burst of air pressure forcibly closes the jaw assembly, locking the plastic clamp 30 tightly about hose 32.

Tool 20 comprises a rigid, pistol grip housing 40 comprising a generally cylindrical barrel 42 having a fork-like applicator end 41 (FIG. 3) and an opposing butt end 45. In the best mode, barrel 42 is constructed of hardened, polished steel. A contoured, generally tubular handle 50 disposed beneath butt end 45 provides a comfortable gripping surface 55. External surface 55 comprises a plurality of grooves 57 receiving the user's fingers 59. Preferably handle 50 is constructed of a durable ABS plastic. Handle 50 mounts trigger assembly 38 conveniently within reach of the user's index or trigger finger 59A. The trigger assembly can be depressed to actuate a pneumatic valve assembly 75 (FIGS. 4, 5) disposed in fluid flow communication with high pressure air applied from a conventional external source by line 77 and fitting 78.

Barrel end 41 comprises a pair of integral, spaced apart, parallel arms 83, 84, defining a mounting channel 81 (FIG. 3) therebetween. Arms 83, 84 project outwardly from barrel end 41 and terminate in smoothly tapered nose portions 85. Aligned orifices 79, 79A formed in arms 84 and 83 respectively (FIG. 3) enable mounting of the pivotal jaw assembly 35 within mounting channel 81.

Figure 5:
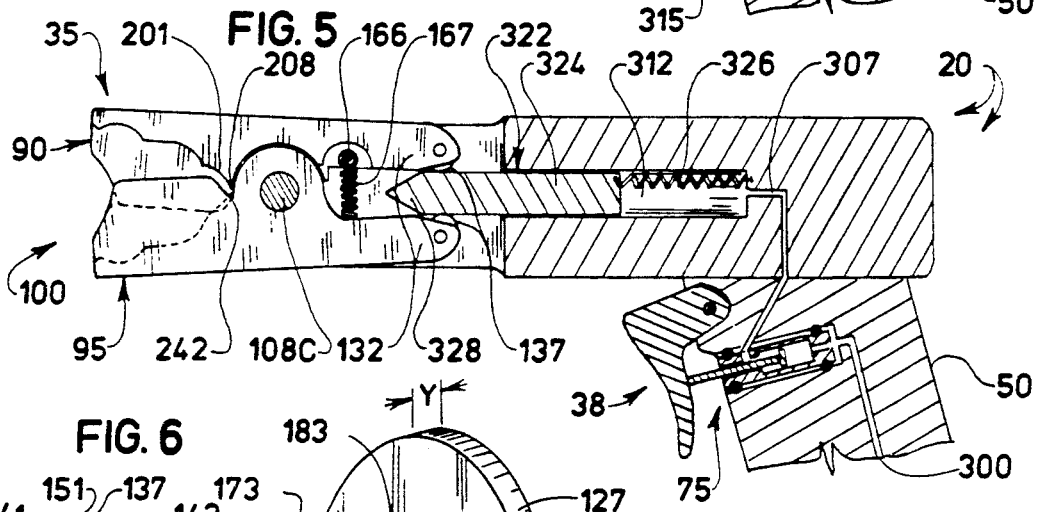
FIG. 5 is a fragmentary, sectional view similar to FIG. 4, but illustrating the mouth in its closed position.
Figure 6:
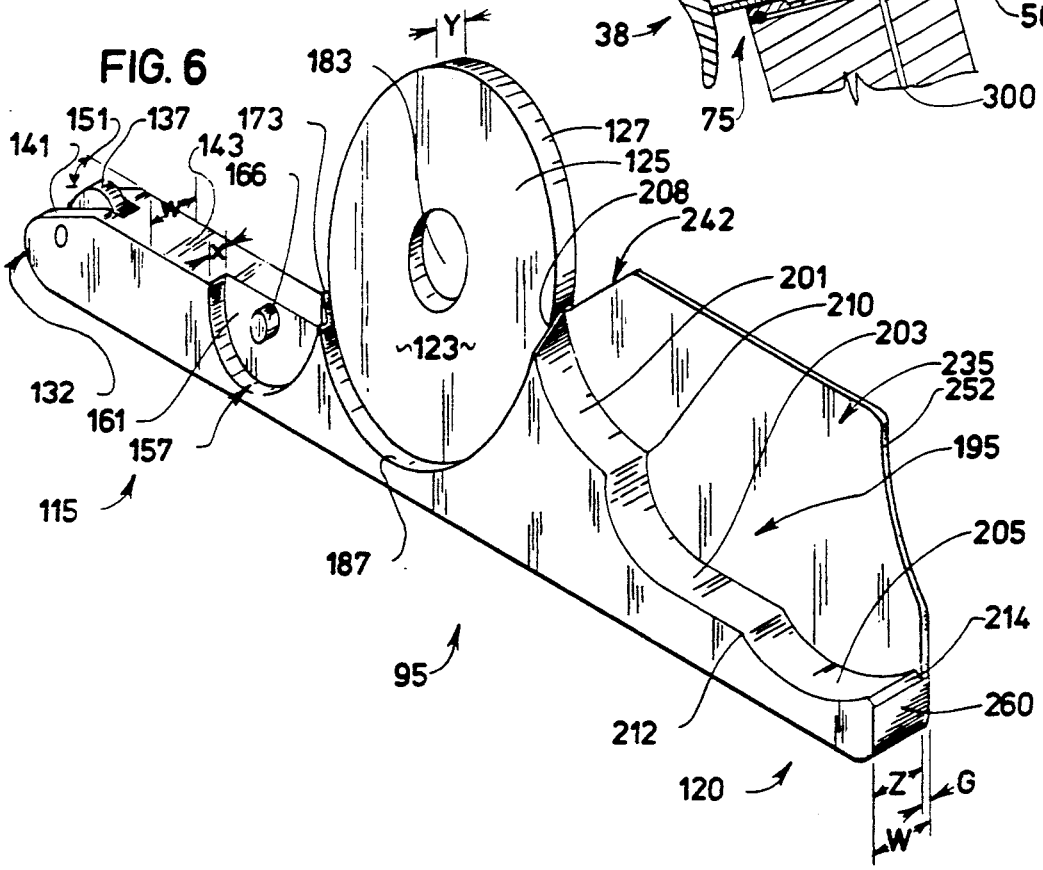
FIG. 6 is an enlarged, isometric view of a preferred jaw.

Jaw assembly 35 preferably comprises a pair of identical jaws 90 and 95, each having inner and outer symmetrical surfaces. The inner surfaces of the jaws face each other. Jaws 90 and 95 form a contoured, clamp-receptive mouth broadly designated by the reference numeral 100. The jaws 90, 95 are pivotally mounted between arms 83 and 84 within channel 81 by a rigid, partially threaded trunnion 108 that axially penetrates orifices 79, 79A, and the clamping members. Trunnion head 108B is captivated for rotation within arm orifice 79 (FIG. 3). Trunnion collar 108C (FIG. 2) penetrates the jaws and forms a bearing surface within jaw orifices 183 (FIG. 6). The threaded trunnion shank 108E is threadably fastened to threaded insert 109 (FIG. 3) press fitted into orifice 79A. Trunnion 108 defines the axis of rotation about which jaws 90, 95 pivot between the "open" position viewed in FIGS. 1 and 4 and a "closed" position viewed in FIG. 5. Jaw pivoting, as hereinafter explained, is caused by a pneumatic plunger activated by the trigger assembly.

With primary reference directed now to FIGS. 6–9, jaws 90, 95 are symmetrically configured and are preferably constructed of hardened steel. Each jaw comprises a contoured terminal end 115 separated from a spaced-apart, specially configured gripping end 120 by an integral, generally circular bearing plate 125. Bearing plate 125 comprises circular inner surface 123 (FIG. 6) and an outer, circumferential edge 127. Surface 123 is offset from an adjacent, symmetrical ledge 187. Each bearing plate 125 projects integrally, outwardly beyond terminal end 115, and each comprises a central orifice 183 for coaxially receiving trunnion 108. In assembly the bearing plates 125 of each jaw will be aligned for relative rotation, and the semicircular ledge 187 defined adjacent bearing plate 125 will clear the edge 127 of the opposite jaw. During a clamp installation cycle bearing plates 125 thus facilitate pivoting of jaw gripping ends 120.

Each jaw terminal end 115 comprises a rigid fork 132 which captures a rotatable roller 137 exposed for rotatable contact between angled edges 141. In the best mode, edges 141 project away from surface 143 at an angle 151 of roughly thirty to forty degrees. Jaw end surface 143 defines a first width W (FIG. 6) of roughly 0.300 inches. Plate 125 preerably comprises a width Y roughly one-half width W, or approximately 0.15 inches.

A circular recess 157 is defined adjacent surface 143 between jaw fork 132 and bearing plate 125. Each recess 157 comprises a semicircular rear wall 161 from which a rigid boss 166 projects. Tensioning spring 167 (FIGS. 4, 5) extends between bosses 166 to normally bias jaws 90, 95 to the open position viewed in FIGS. 1 and 4. When tool 20 is activated to close mouth 100, jaw terminal ends 115 are forced apart against yieldable bias from spring 167 (FIG. 5). When an installation cycle is complete, spring 167 pulls terminal ends 115 together and opens mouth 100. As best viewed in FIGS. 6 and 8, the depth X of recess 157 is roughly one-third the width W of jaw end 115. Radius R (FIG. 7) is approximately 0.375 inches. Recess 157 terminates adjacent bearing plate 125, and is separated therefrom by a rigid ledge 173 (FIGS. 6, 8) which projects beyond surface 143.

With specific reference to FIG. 6, gripping end 120 comprises a clamp-receptive gripping surface broadly designated by the reference numeral 195. Gripping surface 195 comprises a plurality of serially linked, cooperating channels 201, 203, and 205 defined between rigid, outwardly projecting teeth 208, 210, 212, and 214. Front tooth 214 is beveled, so that it positively engages the serrations of the locking head 31 (FIG. 1). Rear tooth 208 defines an angular slot 220 (FIG. 2) between ledge 187 and bearing plate 125 (FIG. 2). As mouth 100 rotates to its closed position, teeth 208, 210 and 212 are compressed towards each other.

In the best mode gripping surface 195 defines a fourth width Z roughly four-fifths width W, or approximately 0.240 inch. Channel 201 comprises a radius R1 of roughly 0.125 inch. Channel 203 comprises radius R2 of roughly 0.250 inches and channel 205 comprises a radius R3 of roughly 0.188 inches. The teeth 210 and 212 formed between cooperating pairs of channels engage opposite ends of the clamp's locking head 31. Clamps or fasteners of varying dimensions are accommodated by the differently configured channels 201, 203, and 205. For example, hose clamp 30 of FIG. 1 fits within and between channels 205 of the opposed jaws. An elongated, crown-type clamp would fit well between channels 203. Thus the tool is adapted for variously configured clamps.

The clamp locking head 31 must be retained in proper alignment during installation so that a tight, leak-proof lock is achieved. Twisting deformations during compression must be prevented, so that opposite legs of the clamp cannot escape from the clamp teeth. Rigid, integral retaining walls 235 (FIG. 6) cooperate to securely capture clamp 30 within mouth 100 and prevent lateral or torsional displacement during installation. Walls 235 projects integrally, generally perpendicularly from gripping surface 195 between bearing plate 125 and front tooth 214. The width G (FIG. 2) of each wall 235 is approximately 0.050 inches. The combined width Z of gripping surface 195 and width G of the retaining wall 235 is equal to the width W of the terminal end of the jaw assembly.

Figure 7:
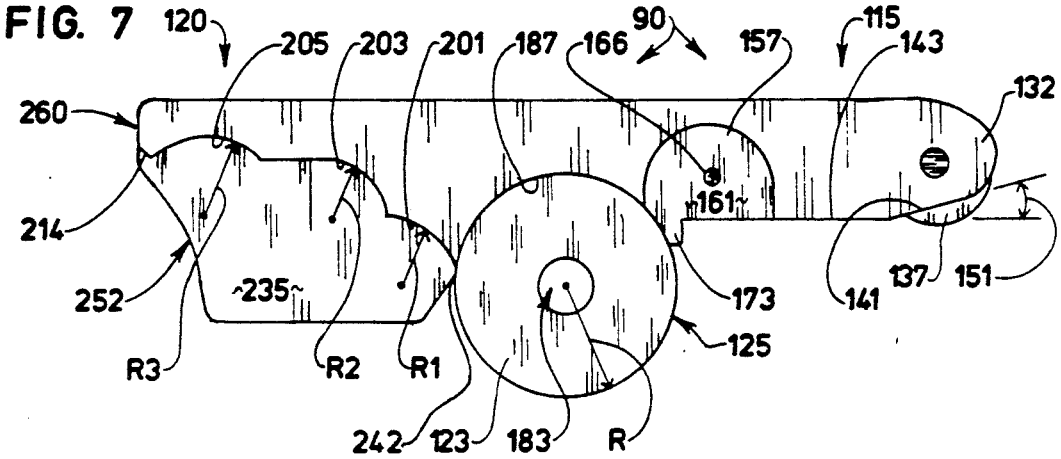
FIG. 7 is an enlarged elevational view of the upper jaw, showing its inner face.
Figure 8:
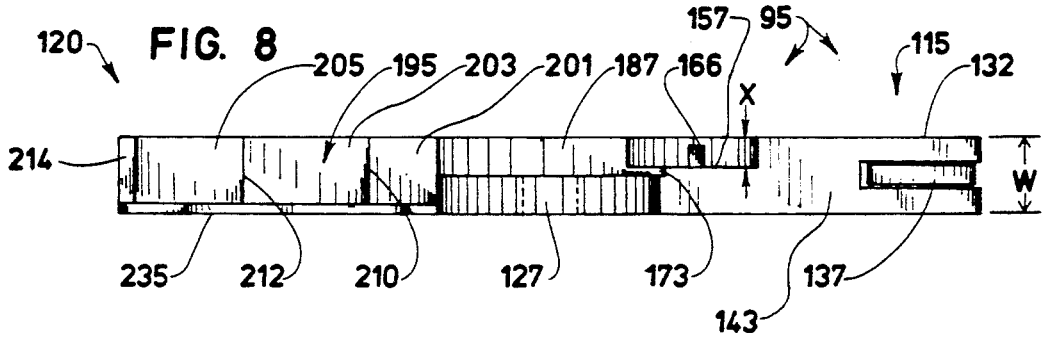
FIG. 8 is an enlarged, top elevational view of the lower jaw of FIG. 6; and, FIG. 9 is an elevational view of the outer face of the lower jaw, wherein dashed lines have been employed to indicate interior structure.
Figure 9:
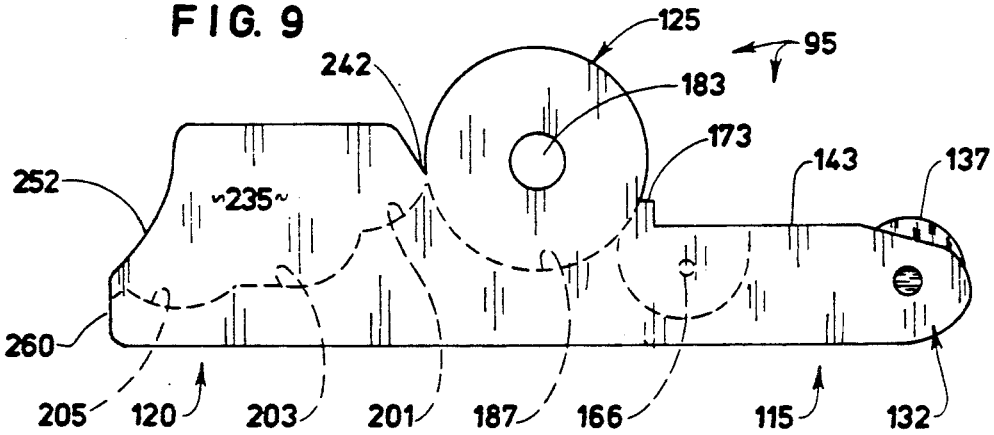

Retaining walls 235 are generally parallel. Walls 235 firmly secure locking head 31 against undesired displacement, whether mouth 100 is open or closed. When mouth 100 closes, as in FIG. 5, walls 235 virtually completely enclose locking head 31. Each wall 235 terminates in a generally V-shaped notch 242 (FIGS. 7, 9). The opposite, anterior end of wall 235 comprises an arcuate cutaway 252. As best viewed in FIG. 1, clamp 30 is preferably positioned so that locking head 31 projects outwardly beyond cutaway 252. Thus undesired contact between wall 235 and clamp 30 or hose 32 is avoided during installation. For the same reason, terminal face 260 of gripping end 120 is smoothly rounded, so that it does not accidentally pierce clamp 30, hose 32, or the user's hand 25 during use.

Mouth 100 is selectively opened and closed in response to activation of trigger assembly 38 and valve assembly 75. The valve assembly 75 establishes fluid flow communication between the external pneumatic source and the housing 40. With primary reference now directed to FIGS. 4 and 5, valve assembly 75 is in fluid flow communication with passageway 300 which extends interiorly of handle 50 and receives air from line 77 (FIG. 1). A vertical passageway 307 extends between cylinder 303 and chamber 312, which is defined horizontally within housing 40. A conventional poppet valve 315 slidably displaceable within cylinder 303 selectively opens and closes passageway 307 to transmit air into chamber 312.

Cylindrical chamber 312 is generally horizontally disposed interiorly of housing 40. Chamber 312 slidably receives the rigid, generally cylindrical plunger 322 which deflects the jaws. Plunger 322 comprises an elongated body 324 and an integral tip 328. Plunger 322 is horizontally, slidably displaceable within chamber 312 and its travel is limited generally by resilient return spring 326. Spring 326 is anchored to the terminal end of chamber 312 and contacts plunger 322.

Figure 4:
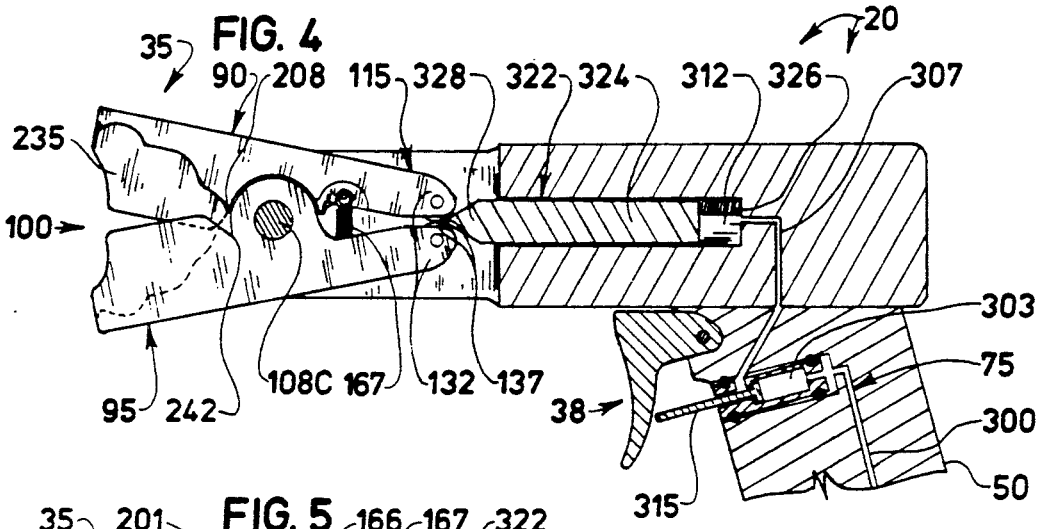
FIG. 4 is a fragmentary, longitudinal sectional view taken generally along line 4—4 of FIG. 3, illustrating the mouth in its open position.

When the tool is in its quiescent state as viewed in FIG. 4, tip 328 of plunger 322 rests upon terminal end 132 of the jaws 90, 95, and its point projects into the gap defined between rollers 137. When the trigger assembly 38 is activated, pressurized air enters chamber 312 and forcibly impacts plunger 322. The plunger is driven forward against jaw rollers 137, forcing tip 328 between the jaw terminal ends 115, and entering the interior of jaw assembly 35.

As plunger 322 enters the jaw assembly, jaws 90, 95 are forced to rotate about trunnion 108 so that their gripping ends 120 pivot together, closing mouth 100 (FIG. 5). As the mouth closes the clamp 30 is compressed. After an installation cycle is completed, the trigger is released, and poppet valve 315 cuts off air flow into chamber 312. When pressure is thus released, return spring 326 retracts plunger 322, venting air out passageway 307. Jaw terminal ends 115 are drawn together by contraction of spring 167. As the terminal ends close together under force of spring 167, jaws 90, 95 rotate about trunnion 108, forcing mouth 100 back to the open position of FIG. 4.

Based on our experimentation, clamps of different sizes demand application of varying amounts of pressure. Preferably the system permits selective delivery of air pulses at a pressure of between 20–100 psi.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A power tool for installing locking hose clamps, said tool comprising:

housing means adapted to be grasped by a user for controlling said tool;

jaw means pivotally secured to said housing means for receiving and thereafter compressing a clamp to be installed, said jaw means comprising:

a pair of cooperating, pivotally linked jaws each comprising a terminal end, a gripping end spaced apart from said terminal end, and an integral, bearing plate disposed between said terminal and said gripping ends;

said gripping end comprising a contoured gripping surface for engaging said clamp and an integral retaining wall adjacent said gripping surface for preventing clamp deformation and escape, said surface comprising a plurality of serially connected arcuate channels separated by rigid teeth for securely gripping a clamp to be installed; and, a clamp-receptive mouth defined between said gripping surfaces and said walls; and, means associated with said housing means for selectively activating said jaw means.

2. The tool as defined in claim 1 wherein said means associated with said housing means for selectively activating said jaw means comprises plunger means for forcibly contacting said jaw terminal ends to forcibly pivot said jaws to a closed position.

3. The tool as defined in claim 2 wherein said housing means comprises interior chamber means for operatively receiving said plunger means and interior passageway means establishing fluid flow communication between said chamber means and an external fluid source.

4. The tool as defined in claim 3 wherein said handle means comprises trigger means for selectively pressurizing said chamber means to forcibly drive said plunger means into contact with said jaws.

5. The tool as defined in claim 4 wherein said jaws are pivotally coupled together by a rigid trunnion which penetrates each of said bearing plates and is received within said housing means.

6. The tool as defined in claim 5 wherein each of said channels is characterized by a radius, and wherein each said radius is adapted to accommodate a clamp of different size and configuration.

7. The tool as defined in claim 6 including spring means for yieldably biasing said jaws to an open position.

8. The tool as defined in claim 7 wherein said plunger means further comprises return spring means for retracting said plunger means out of engagement with said jaws after compression of a clamp to be installed.

9. A power tool for installing locking hose clamps, said tool comprising:

housing means adapted to be grasped by a user for controlling said tool;

jaw means emanating from said housing means for receiving and thereafter compressing a clamp to be installed, said jaw means comprising:

a pair of cooperating, pivotally linked jaws, each jaw comprising a terminal end and a gripping end spaced apart from said terminal end;

each gripping end comprising a contoured gripping surface for engaging said clamp and an integral retaining wall adjacent said gripping surface, said surface comprising a plurality of serially connected arcuate channels separated by rigid teeth for securely gripping a clamp to be installed, said gripping surfaces and said retaining walls forming a clamp receptive mouth;

plunger means for forcibly contacting said jaw terminal ends to forcibly pivot said jaws to close said mouth to install a clamp; and, pneumatic means for selectively activating said plunger means.

10. The tool as defined in claim 9 wherein said pneumatic means comprises interior chamber means for operatively receiving said plunger means and trigger means for selectively pressurizing said chamber means to forcibly drive said plunger means into contact with said jaws to activate same.

11. The tool as defined in claim 10 wherein each jaw comprises an integral bearing plate disposed between said terminal and gripping ends, and said jaws are pivotally coupled together by a rigid trunnion which penetrates each of said bearing plates and is received with said housing means.

12. A pneumatic power tool for installing a resilient, locking clamp upon a hose or the like, said tool comprising:

housing means adapted to be grasped by a user for controlling said tool, said housing means comprising a rigid, elongated barrel and pistol grip handle means for enabling comfortable manipulation of said tool;

an upper jaw comprising a terminal end and a gripping end spaced apart from said terminal end by an integral bearing plate, said gripping end comprising a retaining wall and a plurality of arcuate channels separated by rigid clamp-engaging teeth;

a lower jaw comprising a terminal end and a gripping end spaced apart from said terminal end by an integral, generally planar bearing plate, said gripping end comprising a retaining wall and a plurality of arcuate channels separated by rigid clamp-engaging teeth;

a clamp-receptive mouth formed by said gripping ends of said jaws, the mouth having sides formed by said sidewalls;

wherein said upper and lower jaws are pivotally coupled together by a rigid trunnion, said trunnion defining an axis of rotation about which said bearing plates rotate to open and close said mouth;

plunger means for selectively activating said jaw means, said plunger means slidably disposed within said barrel for displacement between a first position contacting the terminal ends of both jaws and a withdrawn position; and, trigger means associated with said handle means for selectively activating said plunger means to operate said tool.

13. The tool as defined in claim 12 wherein said arcuate channels cooperate to accommodate clamps of varying sizes and configurations.

14. The tool as defined in claim 13 wherein said terminal end of said upper and lower jaws each comprise bearing means adapted to be forcibly contacted by said plunger means.

15. The tool as defined in claim 14 including spring means for biasing said jaws to an open position, and wherein said plunger means comprises return spring means for retracting said plunger means out of engagement with said jaws after said clamp is locked.

* * * * *